United States Patent [19]

Godbey

[11] 4,176,894

[45] Dec. 4, 1979

[54] INTERNAL ELECTRICAL INTERCONNECT COUPLER

[76] Inventor: Josiah J. Godbey, 812 Nottingham Dr., Richardson, Tex. 75080

[21] Appl. No.: 873,267

[22] Filed: Jan. 30, 1978

[51] Int. Cl.[2] ..... H01R 3/04

[52] U.S. Cl. ..... 339/15; 339/94 R; 339/177 R

[58] Field of Search ..... 339/15, 16 R, 89 C, 339/94 R, 94 C, 177 R

[56] References Cited

U.S. PATENT DOCUMENTS

| | | | |
|---|---|---|---|
| 2,000,716 | 5/1935 | Polk | 339/15 |
| 2,178,931 | 11/1939 | Crites et al. | 339/16 R |
| 2,301,783 | 11/1942 | Lee | 339/16 R |
| 2,531,120 | 11/1950 | Feaster | 339/16 R X |
| 3,184,706 | 5/1965 | Atkins | 339/89 C |
| 3,206,540 | 9/1965 | Cohen | 339/89 C |
| 3,253,245 | 5/1966 | Brandt | 339/16 R |
| 3,829,816 | 8/1974 | Barry et al. | 339/16 R |
| 4,012,092 | 3/1977 | Godbey | 339/16 R |

*Primary Examiner*—Roy Lake
*Assistant Examiner*—DeWalden W. Jones
*Attorney, Agent, or Firm*—Joseph H. Schley; Thomas L. Cantrell

[57] ABSTRACT

An internal electrical interconnect coupler of an electrical conductor assembly for use with a tubular fluid conductor composed of lengths of pipe having their ends interconnected in spaced relationship by external couplers wherein an electrical conductor for said assembly is provided by thin ductile electrically conductive tubes disposed within the pipe lengths and electrically insulated therefrom by complementary pliant dielectric sheaths which envelope said tubes. Flared extremities of each sheathed tube conform to internal end portions of each pipe length so as to anchor said tube against relative displacement. Internal interconnect coupler is adapted to be mounted in box end of each pipe length or its external coupler and has an electric conductor body for electrically connecting the end portions of adjacent inner conductor tubes, and an elastic dielectric collar is mounted on the body for engaging the contiguous box and pin ends of adjacent pipe lengths to electrically insulate said tube extremities from adjacent pipe and external coupler interior surfaces. When coupled, external couplers of adjacent pipe lengths deform elastic collar between box and pin pipe ends into fluid tight sealing engagement with tube extremities and adjacent pipe and coupler internal surfaces. The inner end portion of each electrical conductor body is expandable into engagement with the bore of the tube within each pipe length inwardly adjacent its box to secure internal interconnect coupler therein.

22 Claims, 3 Drawing Figures

INTERNAL ELECTRICAL INTERCONNECT COUPLER

FIELD OF THE INVENTION

Electrical transmission systems having an electrical conductor assembly for various types of tubular fluid conductors composed of lengths of pipe having their adjacent ends connected in spaced relationship by external couplers, such as a well drill string having screwthreaded coupling collars connecting the ends of adjacent lengths of drill pipe, so that the interiors of the end portions of said pipe or their external couplers, including their transverse surfaces and the end portions of electrically conductive inner conductor tubes confined within said pipe, remain exposed for coacting engagement by an internal electrical interconnect coupler, as disclosed in my U.S. Pat. No. 4,012,092. Pipe and external couplers may be electrically conductive and coact to provide an outer electrical conductor for an electrical coaxial conductor assembly and said external couplers may be integral with ends of pipe.

BACKGROUND OF THE INVENTION

It is well known that the efficiency of an electrical conductor assembly for tubular conductor pipe is primarily dependent upon the positiveness of the electrical and mechanical connection, between the ends of the inner conductor tubes within adjacent lengths of outer pipe, provided by internal interconnect couplers. Due to the electrical conductivity and sturdiness of the pipe and external couplers, it is readily apparent that the durability of the internal interconnect couplers is most critical since it is necessary to repeatedly break down and remake drill strings, such as when changing drill bits, and other similar pipe. Accordingly, the internal interconnect couplers must conduct electrical current between adjacent inner conductor tubes as well as electrically insulate and mechanically seal off the ends of said tubes from the contiguous inner surfaces of the end portions of external couplers of the outer conductor pipe.

Representative examples of the prior art include the following U.S. Pat. Nos.:

Polk—2,000,716
Crites et al—2,178,931
Lee—2,301,783
Feaster—2,531,120
Atkins—3,184,706
Brandt—3,253,245
Barry et al—3,829,816
Godbey—4,012,092

The internal interconnect coupler of my patent, supra, as well as other prior art disclosures are not completely satisfactory in that they are relatively fragile and/or of insufficient durability and sturdiness to withstand the aforesaid necessity of repeatedly breaking and remaking the tool joints of drill strings or external couplers of other tubular conductor pipe. It is noted, however, that the prior art couplers are sufficiently durable to function over extended periods of time if there is not excessive making and breaking or coupling and uncoupling of said tool joints, pipe or external couplers of said pipe.

In my patent, it is difficult to maintain a fluid tight seal between the ends of each inner electrical conductor tube and the contiguous pin and box ends of the pipe which may form an outer electrical conductor of an electrical coaxial assembly, particularly, about the lower or inner contact ring of the internal interconnect coupler. The elastic material of the annular packing element of the latter cannot be made of sufficient firmness to maintain its deformed shape and prevent displacement of said coupler. Initial unthreading as well as final threading of the pin and box pipe ends tends to rotate and displace this coupler from the box since only the frictional engagement of the packing element with the screwthreads of said box is provided for holding said coupler in place when the pipe is uncoupled. Also, the pressure exerted on the elastic packing element upon "making up" a tool joint or external coupler causes it to expand inwardly as well as outwardly and thereby reduce the internal diameter of the pipe. In addition, the electrical current carrying capacity of the interconnect coupler is limited by the diameter of the spring wire extending between and connecting the contact rings at the ends of said coupler, and this limiting resistance increases with the addition of each length of pipe and coupler.

As set forth in my patent, supra, the expired patent to Polk discloses an electrically insulated coaxial conductor assembly wherein the drill string is utilized as the outer electrical conductor and detachable electrically insulated helical springs are used as interconnect couplers between adjacent sections of the inner electrical conductor. This assembly, however, involves repeated engagement and disengagement of coaxial insulated parts and the likelihood of irreparable damaging due the rough handling encountered during coupling and uncoupling of drill pipe. In FIG. 2, a helical spring engages and electrically connects adjacent ends of inner tubular conductor sections which are electrically insulated from drill pipe by dielectric liners. In FIG. 3, the inner electrical conductor sections comprise insulated electrical wires or rods secured by tubular sheaths to metallic collars or sleeves mounted in the bore of drill pipe between adjacent inner conductor sections. Ends of wires or rods are electrically connected to ends of springs by annular rings. Fragile structure due to telescopic ends of liner sections.

In the expired patent to Crites et al, one or more insulated electrical conductors are mounted in exterior of tubing and each length of tubing has built up male and female joints at its ends with longitudinal openings therein for receiving the end portions of one or more coextensive electrical conductors sections. Each conductor section is insulated exteriorly and from the tubing by a tubular dielectric sleeve of substantially the same external diameter as the tubing joints. Electrical contacts are secured to the ends of each electrical conductor section and have complementary tapered surfaces exposed to the interior of each box or socket and the exterior of each pin so as to engage when the joints are coupled.

The expired Feaster patent discloses sections or lengths of pipe of novel (uncommon) construction, each having an exposed conduit for an electrical conductor extending longitudinally of and contiguous its bore. The ends of each conduit are embedded in the enlarged pin and box ends of the pipe for connection with an electrical contact pin and an electrical contact ring, respectively, embedded in the end faces of said pin and box. Flat interengaged faces of annular insulating bodies or rings, which surround the contact pin and contact ring, will not withstand any appreciable fluid pressures much less the relatively high pressured encountered in oil wells. Leakage between the insulating rings short circuits the electrical connection.

The expired Lee patent discloses an electrical circuit for each length of pipe comprising a plurality of exposed coextensive wires exposed to the well fluids and respectively connected at each end to screws which are embedded in annular insulating rings disposed within the male and female coupling members of the pipe and which are connected to embedded electrical contacts having outer end portions for respective engagement with one another. The exposed wires are most undesirable.

The coaxial cable connector of the patent to Atkins has an axial center conductor embedded in dielectric member which insulates it from outer tubular conductor enclosed in dielectric sheath or cable jacket. Discloses camming members having coacting tapered surfaces for deforming gaskets and crimping. No fluid conductor shown.

In the patent to Brandt, the drill string is employed as an outer electrical conductor and an electrical conduit extending longitudinally of each length of pipe forms the inner electrical conductor. An electrical cable, containing insulated wire, is disposed within each conduit and the ends of the wire are connected to electrical contact rings embedded in elastic collars and adapted to mate when pipe is coupled.

The Barry et al patent discloses an electrical coupling assembly having plug type connectors with coacting pins and sockets engageable and disengageable upon relative linear movement of pin and box members of coupling. Not useable with screwthreaded coupling members.

SUMMARY OF THE INVENTION

This invention relates to new and useful improvements in electrical and mechanical connections between the adjacent ends of electrically conductive cylindrical tubes or tubular members of an electrical conductor assembly adapted for use with a tubular fluid conductor composed of lengths of pipe having their adjacent ends interconnected in spaced relationship by external couplers, such as a well drill string having coacting screwthreaded male and female (pin and box) coupling collars connecting the ends of adjacent lengths of pipe so as to provide an outer electrical conductor for the assembly. An inner electrical conductor for the conductor assembly is provided by tubes or tubular members, of thin ductile or deformable electrically conductive material, disposed within the lengths of outer conductor pipe and electrically insulated from said pipe by complementary liners or sheaths, of thin dielectric pliant or deformable material, which envelope the exteriors of said tubes. The ends of the tubes and sheaths are flared outwardly to form lips which conform to the contiguous surfaces of the interiors of the outer and inner extremities of the pin and box ends, respectively, of adjacent lengths of pipe. Reference is made to my patent, supra, for details of construction and relationship of the tubes and sheaths to the pipe as well as to each other.

An internal electrical interconnect coupler is provided for connecting the end portions of the electrically conductive tubes of adjacent pipe lengths. Since this electrical conductor is oriented vertically in the drawings and since it coacts with the interior of the outer end portion of the pin of the male coupling collar and the bottom or inner end portion of the box of the female coupling collar, the terms "upper" and "lower" are used herein interchangeably with either of the terms "outer" and "inner". This internal coupler has an inner cylindrical electrical conductor body for engaging within and electrically connecting the adjacent end portions of the bores of the electrically conductive tubes of the inner conductor. An elastic dielectric collar or annular packing element is mounted on the exterior of the inner conductor body for engagement with the contiguous surfaces of the pin and box ends of adjacent lengths of pipe and the flared lips of the inner electrical conductor tubes and liners so as to electrically insulate the ends of the latter from adjacent interior surfaces of the pipe or external coupler.

Preferably, the collar is externally screwthreaded for mating engagement with the internally screwthreaded socket of the box end of the pipe, and the major upward or outer portion of said collar has slidable connection with the body so as to permit deformation of said collar downwardly or axially inward relative to said body and toward the inner or lower extremity of said socket so as to fill the voids therein. A sleeve, having the internal surface or wall of the collar bonded to its external surface, may be slidable confined on the exterior of the body above its inner or lower end for moving inwardly or downwardly with the deformation of said collar. The inner or lower end of the collar is bonded to the lower or inner end portion of the body exterior below or inwardly of and spaced from the sleeve. An internal annular cavity in the elastic dielectric collar communicates with the interior or the inner electrical conductor through openings in the cylindrical wall of the body, whereby the interior of said collar is exposed to the pressure of fluid therein, such as within a drill stem, so as to be deformed radially outward and thereby provide additional force for increasing its fluid tight sealing and electrical insulating capabilities necessitated by said fluid pressure.

The lower or inner end portion of the inner electrical conductor body is adapted to be expanded radially into frictional engagement with the bore of the electrically conductive tube inwardly or below the screwthreaded socket of the female coupling collar for preventing displacement of the internal interconnect coupler when the pin of the adjacent pipe is unthreaded from said socket. Preferably, the inner or lower end portion of the body is slitted or otherwise separated longitudinally to provide a plurality of axially extending fingers which are flexible radially outward into and held in the aforesaid frictional engagement by a tapered locking ring or other wedge element adapted to be screwthreadedly or otherwise secured within said body lower end portion. Prior to this expansion of the lower end portion of the body, the interconnect coupler is set in the box by the coaction of the external screwthreads of the elastic collar and the internal screwthreads of said box or its socket.

In addition, the top or outer end of the inner end of the inner conductor body is engaged and forced downwardly or inwardly by a tube or tubular tool, resembling the pin portion of a male coupling collar, which is adapted to be screwthreaded into the box for deforming the inner or lower end portion of said collar into fluid tight sealing engagement with the upper or outer flared lips of the underlying inner electrical conductor tube and liner as well as the adjacent bottom or inner extremity of the box or socket of the female coupling collar. Then, the tapered locking ring is screwthreaded inwardly or upwardly relative to the body for expanding its lower or inner end portion so as to maintain said collar in its deformed position when the tool or the pin of the pipe or its male coupling collar is removed. Upon reengagement of the pin, it is only necessary for the flared lip of its electrically conductive tube to deform the outer or upper extremity of the elastic collar into sealing engagement therewith and with the contiguous lip of the liner and interior surfaces of said pin. Preferably, the upper or outer end portion of the body is slitted in the same manner as its lower or inner end portion so as to be flexed radially inward when engaged in the bore of the tube within the pin for more positive electrical contact with said bore.

DESCRIPTION OF A PREFERRED EMBODIMENT

Figure 1:
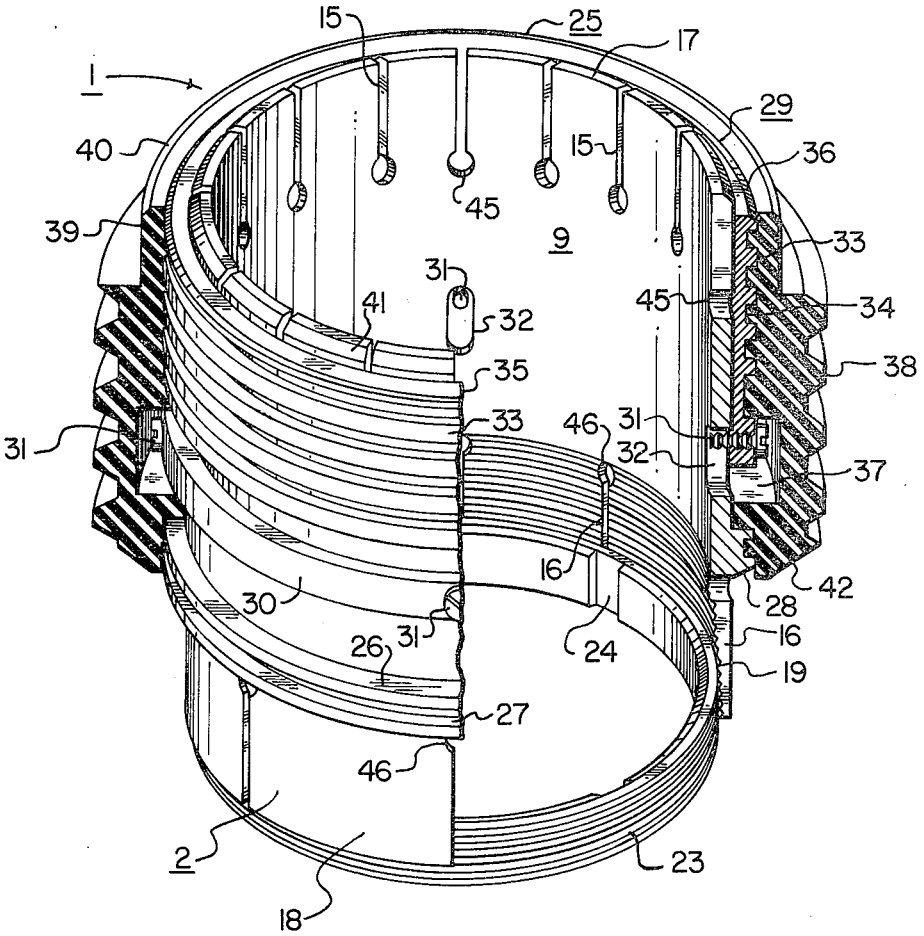
FIG. 1 is an enlarged perspective view, partly in section, of an internal electrical interconnect coupler constructed in accordance with the invention.

In the drawings, the numeral 1 designates an internal electrical interconnect coupler embodying the principles of the invention and having an annular tubular body or cylindrical member 2 of brass or other electrically conductive material and, as will be apparent hereinafter, is of greater length than the distance or space between the interior of the outer or lower extremity 7 of externally screwthreaded pin 5 and the bottom or inner or lower extremity 8 of internally screwthreaded box or socket 6 of adjacent lengths of metal pipe or other vertical or longitudinally disposed metallic tubular fluid conductors (FIG. 3) having male 3 and female 4 coupling collars integral with or secured to opposite ends thereof so as to provide an external coupler for said adjacent lengths of pipe. It is noted that the internal screwthreads of the box or socket terminate outwardly or upwardly of its inner or lower extremity 8. Internal electrical interconnect couplers 1 form essential parts of the inner electrical conductor of an electrical conductor assembly wherein electrically conductive pipe and coupling collars 3, 4 may be utilized to provide an outer coaxial electrical conductor for said conductor assembly. Except for the electrical interconnect couplers, this assembly may be generally identical to the electrical conductor assembly of my aforesaid patent.

Figure 3:
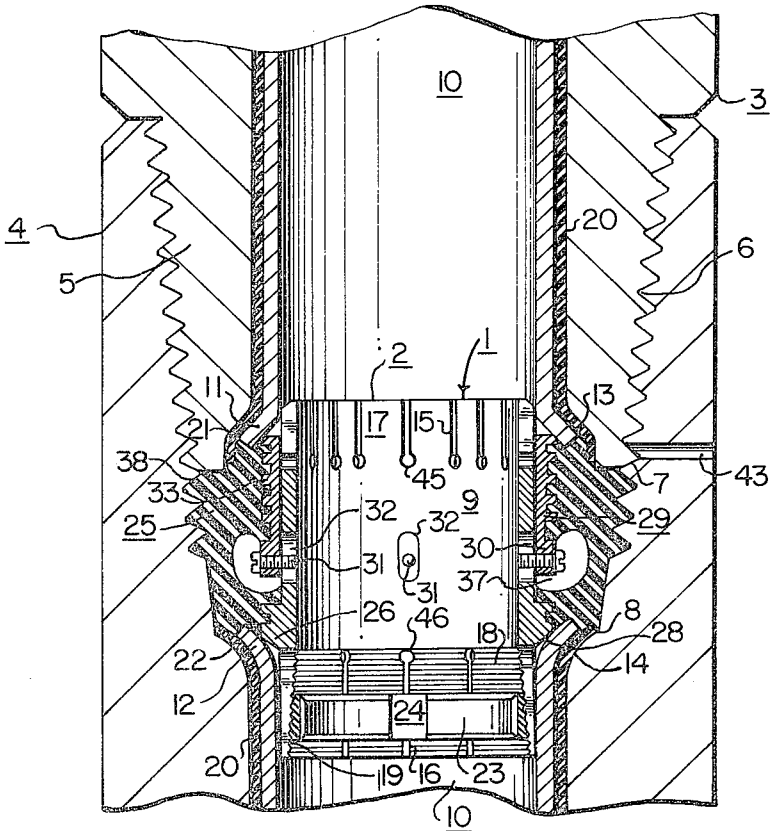
FIG. 3 is a view, similar to FIG. 2, showing said adjacent box and pin ends of said pipe coupled and the deformation of said elastic packing element of said interconnect coupler into sealing engagement with said flared ends of the tube and liner within said pin as well as contiguous interior surfaces of said pin.
Figure 2:
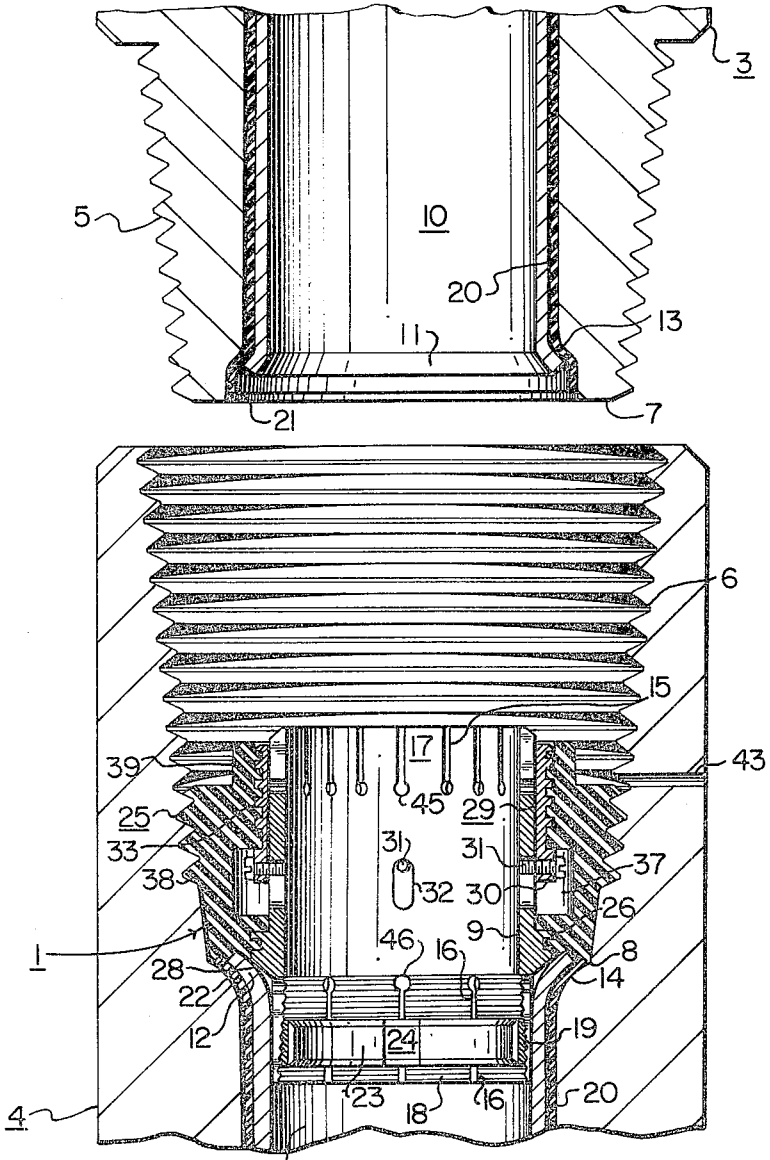
FIG. 2 is a transverse vertical sectional view of the box and pin ends of adjacent lengths of pipe showing the inner electrical conductor tubes insulated from said pipe and the flared ends of said tubes, the aforesaid interconnect coupler being seated in the inner end portion of the socket of the box end of one pipe and the deformation of its elastic annular packing element into sealing engagement with said inner or lower end portion of said socket and the contiguous flared end of the adjacent tube.

As shown in FIGS. 2, 3, a complementary cylindrical tube or tubular member 10, of thin ductile electrically conductive material (such as annealed copper or other metal having high ductility, high electrical conductivity and high resistance to corrosion, errosion or other deterioriation) is mounted within each pipe. Tubes 10 form essential parts of the electrical inner conductor of the coaxial conductor assembly. Each tube 10 is confined within its pipe by its outwardly flared ends or lips 11, 12 which are adapted to be respectively engaged by tubular conductor body 2 of interconnect coupler 1 and which contiguously conform to the interior of outer extremity 7 of pin end 5, particularly internal bevel 13 of male coupling collar 3, and to bevel 14 of inner extremity 8 of box end 6 of female coupling collar 4.

For electrically insulating each inner electrical conductor tube from the pipe in which it is mounted, said tube is enveloped by a complementary tubular liner or sheath 20 of flexible dielectric material and may be secured to the exterior of said tube, to the interior of said pipe or to both. As more fully described in my patent, supra, the material of each electrical insulating liner 20 permits outward deformation of its ends or lips 21, 22 (with ends 11, 12 of its corresponding tube 10) into contact and conformity with respective bevels 13, 14 of pipe pin end 5 and pipe box end 6 as well as the retention of its flared ends or lips. It is noted that each liner is of greater length than its tube, whereby flared ends or lips 21, 22 of said liner extend outwardly past flared ends or lips 11, 12 of said tube so as to overlie bevels 13, 14 of the aforesaid pin and box pipe ends in generally coextensive relation. The liner material maintains its integrity during expansion or contraction, is highly chemical resistant, has very low liquid absorbtion, provides pressure fluid barriers or seals between the pipe and tubes and retains these characteristics over extreme ranges or pressures and temperatures. Also, the dielectric liners may be formed of tubing or sleeves, such as heat shrinkable polyolefin, polyteterafluorethylene or similar material, shrunk fit upon the electrically conductive tubes or be applied by tape wound upon said tubes or by spray coating said tubes or the interiors of the pipe prior to insertion of said tubes.

As best shown in FIG. 3, annular tubular body 2 of each internal electrical interconnect coupler 1 is of greater length than the distance between the end portions 11, 12 of tubes 10 when the pipe is coupled and has a generally cylindrical wall 9. A multiplicity of equally spaced kerfs or narrow slots 15, 16 extends axially or longitudinally of each of the opposed end portions of wall 9 to provide flexible longitudinal fingers 17, 18, respectively, for relative inward and outward radial flexing upon insertion into the tubes to provide positive electrical contact therewith. As illustrated, outer or upper finger 17 may be narrow relative to lower or inner fingers 18 so as to be more flexible for repeated engagement and disengagement with the bore or internal wall of the adjacent tube above or inwardly of its flared ends or lips upon coupling and uncoupling of the pipe. Preferably, the inner end of each slot 15, 16 is enlarged to provide circular opening 45, 46 which tends to resist tearing or splitting of the adjacent axially aligned portions of the wall.

As shown by the numeral 19, the lower or inner end portion of wall 9 is relatively thin and internally screwthreaded for engagement by an externally screwthreaded locking ring or annular wedge member 23. Internally screwthreaded lower wall portion 19 is tapered outwardly or downwardly, while externally screwthreaded ring 23 is tapered inwardly or upwardly relative to inner electrical conductor body 2, whereby the lower end portion of said body is expanded radially so as flex fingers 18 radially outward upon inward threading of said ring relative to said wall portion (FIG. 2). At least a pair (preferably, two pairs) of opposed internal grooves or slots 24 extends axially of the locking ring for engagement by an internal spanner wrench or other suitable tool (not shown) for rotating said ring inwardly and outwardly of the coupler body.

An external annular packing element or cylindrical collar 25, of suitable elastic dielectric material, is bonded to the exterior of body 2 for electrically insulating and mechanically sealing off flared ends or lips 11, 12 of adjacent tubes 10 from the contiguous internal surfaces of the aforesaid pipe pin end 5 and pipe box end 6 of coupling collars 3, 4. For anchoring elastic electrical insulating packing collar 25 onto the electrical conductor body, an external annular shoulder 26 is provided at the lower end portion of said body immediately adjacent or above circular openings 46 of slots 16 in lower end portion 19 of wall 9. Shoulder 26 is of sufficient axial width to permit the formation of one or more external annular grooves 27 in its medial portion for enhancing its bonding engagement with the interior of the lower end portion of the elastic collar. As shown at 28, the lower or outer surface of the external annular shoulder is bevelled upwardly for engagement with flared end or lip 12 of adjacent tube 10 (FIG. 3).

A complementary cylindrical member or sleeve 29 is slidable confined upon the exterior of the outer or upper portion of the body and, preferably, is formed of the same or similar electrically conductive material. The lower end of sleeve 29 has an external annular radial enlargement or shoulder 30 which is of greater axial than radial width and which is adapted to have pins or screws 31 extending radially inward thereof and screwthreaded therethrough. Axially elongated openings or slots 32 are provided in the medial portion of the conductor body for receiving the inner ends of radial screws 31 so as to permit axial movement of the sleeve relative to said body while preventing relative rotation thereof. Above shoulder 30, the major portion of sleeve 29 has a plurality (such as five) of external annular radial flanges or ribs 33 providing annular grooves or recesses 34 therebetween for interengagement with the internal surface or wall of electrically insulating elastic packing roller 25 so as to amplify the surficial area of said sleeve for bonding the elastic collar thereto. If desired, flanges 33 may be equally spaced and of the same axial width as grooves 34.

As shown at 35, the uppermost rib may be of less axial width than the other ribs and preferably, has its external outer or upper edge 36 bevelled or relieved to provide an inclined amplified surfacial area or annular seat (FIG. 3) for engagement with lower flared end portion or lip 11 of overlying adjacent tube 10. An annular internal cavity or recess 37 is provided in the internal surface of collar 25 and its radial depth is sufficient to accommodate shoulder 30 of the sleeve and the heads of screws 31. Cavity 34 is of greater axial width (approximately twice) than the shoulder to permit axial or longitudinal movement of sleeve 29 and its shoulder relative to conductor body 2; and said cavity communicates with elongated screw openings 32 of said body whereby the interior of the elastic collar is exposed to the fluid pressure within the pipe or other conductor for equalizing the fluid pressures exerted against the exterior and interior of said collar and thereby maintain its electrical insulating properties.

Relatively coarse or large external screwthreads 38, complementary to the inner or lower end portion of the screwthreaded socket of box 6 of female coupling collar 4, are provided on the exterior of collar 25 for mating engagement with said box or socket. The upper or outer end of the elastic packing and electrical insulating collar projects beyond the uppermost or outermost annular rib 35 of sleeve 29 (FIGS. 1, 2) in the normal or undeformed condition of said collar and terminates below the upper end of the electrical conductor body 2. Above or axial outwardly of external screwthreads 38, the elastic collar has a cylindrical relatively thin axially or longitudinally extending flange or nipple 39, of reduced diameter, overlying the peripheral surfaces of external rib 35 and at least adjacent uppermost rib 33 as well as adjacent underlying grooves 35. As shown at 40, the outer or upper extremity of axial nipple 39 may be bevelled or relieved externally to guide said nipple past contiguous flared end 21 of liner 20 within the outer or lower extremity 7 of pin 5 of adjacent overlying male coupling collar 3. It is noted that body 2 projects above or outwardly past collar 25 and slidable sleeve 29 for engagement with the bore or internal surface of the adjacent tube of pin 5 inwardly or upwardly of its flared lower end or lip 11 and, preferably, its projecting extremity is externally bevelled as shown at 41 to guide said extremity past said lip into said tube. It is noted that the lower end of the elastic dielectric collar depends or projects beyond bevelled lower surface 28 of shoulder 26 of the body and tapers upwardly, as shown at 42 in FIG. 1, for engagement with upper flared end or lip 12 of adjacent lower tube 10 (FIG. 2).

The internal electrical interconnect coupler 1 is adapted to be set or installed by screwthreading its elastic electrical insulating annular packing element or collar 25 within the inner or lower portion of box 6 of female coupling collar 4, the screwthreads 38 of said collar mating with the screwthreads of said box. As shown in my patent, supra, a suitable tool may be utilized for this purpose. Then, a tool (not shown) resembling the screwthreaded pin of a male coupling collar and of slightly less internal diameter than electrical conductor body 2 is screwthreaded into box 6 of the female coupling collar to strike and bear against the top or outer extremity of said body for deforming the inner or lower end portion of the elastic collar, particularly its lower tapered external surface 42, into positive sealing engagement with the flared lips 12, 22 of tube 10 and liner 20 and with the inner extremity 8 of said box (FIG. 2). Also, bevelled lower surface 28 of external body shoulder 26 is forced into positive engagement with the upper or outer extremity of flared upper end or lip 12 of the lower tube. With this tool so engaged an internal spanner wrench or other similar tool (not shown) is inserted and engaged with internal axial grooves 24 of locking ring 23 and turned so as to rotate said ring inwardly or upwardly relative to internally screwthreaded and downwardly or outwardly tapered lower or outward end portion 19 of wall 9 of conductor body 2.

Due to the complementary inwardly or upwardly tapered screwthreaded exterior of the locking ring, the lower or inner fingers 18 of the electrical conductor body are expanded radially outward into fricitional engagement (FIG. 2) with the bore or internal surface of the adjacent lower tube 10 so as to provide a positive electrical contact between said fingers and tube bore. Also, this frictional engagement is sufficient to prevent relative displacement or dislodgement or rotation of the coupler from female coupling collar 4, whereby collar 25 and its external screwthreads 38 only need to electrically insulate and provide a fluid seal between the adjacent ends of inner conductor tubes 10 and the contiguous surfaces of the pin and box ends of the outer conductor coupling collars. The locking ring 23 maintains this frictional engagement and deformation of the lower or inner portion of collar 25 upon removal of the wrench as well as when the pin is disengaged from the box of the pipe.

Upon threading the pin 5 of male coupling collar 3 into the box 6 of female coupling collar 4, flared lower end or lip 11 of sheathed metal tube 10 within said pin strikes upper or outer extremity of inner electrical conductor body 2 and the external bevel 41 of said extremity or the bevels of its fingers 17 prevent damaging of said lip as well as assist in guiding said body into the bore of said tube. Due to narrow slots 15, which form the flexible fingers, the upper or outer end portion of the body is of slightly greater diameter than the bore of tube 10 and said fingers are flexed radially inward to facilitate entry into said tube bore and thereby force said fingers into positive electrical contact and mechanical engagement with said bore. Then, the lower extremity 7 of pin 5 of male coupling collar 3 engages and bears inwardly or downwardly upon upper end or top of nipple 39 of dielectric annular packing element or elastic collar 25 and forces said nipple into engagement with inner bevel 13 of said pin extremity and flared lip 21 of liner 20 until it impinges lower or outer extremity of contiguous tube lip 11. Continued downward or inward threading of the pin into the box causes the outer or lower surface of the tube lip to engage external bevel 36 of uppermost annular rib 35 of sleeve 29 and further deformation of the inner or lower portion of the collar.

The flexibility of upper fingers 17 of the conductor body enhances the electrical contact thereof with the bore of the tube. Due to its slidable mounting, sleeve 29 moves axially downward or inward with the dielectric packing collar so as to assist radially outward deformation of said collar while preventing radially inward deformation. It is pointed out that upper or outer bevel 41 of the body tends to prevent damaging of the aforesaid flared lower end or lip of adjacent overlying tube 10 during coupling and uncoupling of the pipe. Also, the bevel 36 of the uppermost rib of collar 25 protects lip 11 in the same manner.

As shown in FIG. 3, final deformation of collar 25 forces its axial upper or outer portion into fluid-tight sealing engagement with the screwthreaded wall of box 6, extremity 7 of pin 5 as well as flared lower tube and liner ends or lips 11, 21, respectively, and remains bonded to annular ribs 33, grooves 34 and uppermost rib 35 of tubular conductor body 2. The deformed lower or inner portion of the dielectric packing collar also seals off annular external shoulder 26 of body 2, its groove 27 and bevel 28, and upper flared end or lip 12 of adjacent underlying tube 10 from the inner or lower extremity or bottom 8 of the box or socket of female coupling 4. Cavity 37 is distorted by deformation of collar 25 and any excess fluid is displaced through communicating slots 32 onto the bore of body 2. Likewise, the cavity is exposed to the pressure of any fluid within the pipe whereby such pressure is exerted upon the interior of the elastic collar and increases deformation of the latter to provide the additional fluid-tight seal between the inner and outer conductor members of an electrical conductor assembly demanded by relatively high fluid pressures within the pipe or other fluid conductor. In addition to fluid sealing or mechanically packing off the interiors of adjacent external male and female coupling collars from the contiguous ends of the inner electrical conductor tubes, said collar electrically insulates said coupling collars interiors from said tube ends as well as the ends of electrical conductor body 2 of the internal interconnect coupler.

If desired, a port or vent opening 43 may extend radially through the wall of female coupling collar 4 and communicate with the medial portion of its box or socket 6 above or outwardly of the elastic dielectric collar (FIG. 2) when it is screwthreaded thereinto, whereby fluid trapped between said box and pin 5 of male coupling collar 3 during coupling thereof may escape. Obviously, this novel internal interconnect coupler may be utilized in any tubular fluid conductor composed of lengths of electrically conductive pipe having their adjacent ends connected in spaced relationship by external electrically conductive couplers and coacting with lengths of electrically conductive tubes disposed therein to provide an electrical conductor assembly.

Tests of the effectiveness of this internal electrical interconnect coupler were made at a laboratory in a test fixture consisting of the pin and box end portions of a standard drill stem having mounted therein inner electrical conductor tubes and dielectric liners as described in my U.S. Pat. No. 4,012,092. A hydraulic pump capable of developing 3000 psi was connected to this test fixture. The internal interconnect coupler was inserted dry into the box end portion of the fixture and was secured, under pressure on the coupler tube, by the locking ring. The box portion was then filled with a saturated salt (NaCl) water solution to simulate a "worst-case" electrically conducting fluid situation. The pin end of the fixture was then screwed into the box end and seated. Spilled solution was replenished and entrapped air was expelled from the fixture. Under these conditions the shunting or leakage resistance caused by the conducting solution was greater than 100 megohms, the highest reading on the ohmmeter employed.

The test fixture was then pressurized to 3000 psi and there was no indication of leakage resistance. This 3000 psi pressure was maintained in the fixture for a period of 72 hours with no measurable leakage resistance. The pressure was then relieved from the fixture and again there was no measurable leakage resistance.

In each of the above tests, 850 volts RMS at 60 Hertz was applied between the electrical conductors of the system with no indication of breakdown or failure. The level of voltage, in these tests, was limited by the voltage step-up transformer employed.

I claim:

1. In an electrical conductor assembly of an electrical transmission system for a tubular fluid conductor composed of lengths of pipe and means externally connecting the ends of adjacent lengths of pipe, an inner electrical conductor for the electrical conductor assembly comprising an electrically conductive tube generally coextensive with and mounted within each pipe length in spaced electrically insulated relationship;

means for electrically connecting and insulating the ends of adjacent electrical conductor tubes from the contiguous ends of adjacent pipe lengths including a generally continuous cylindrical tubular body of electrically conductive material having an external diameter generally equal to the internal diameter of the bores of said tubes for mounting in the end portions of said adjacent tubes so as to extend therebetween and provide electrical contact therewith upon coupling of said external connecting means, an annular element of elastic dielectric material of less axial length than the tubular body and mounted on the exterior thereof in spaced relation to the ends of said body for engagement with said end portions of said adjacent tubes and deformation into fluid-tight sealing engagement therewith and the contiguous internal surfaces of said adjacent pipe lengths so as to electrically insulate said tube ends from said pipe ends, means for maintaining the annular elastic dielectric element in its deformed sealing position and said tubular body against displacement upon uncoupling of said external connecting means, at least one end portion of said body being discontinuous so as to provide discrete resilient members extending longitudinally inward from the outer extremity of said one end portion of said body for flexing radially relative thereto, the means for maintaining said elastic dielectric element in its deformed sealing position comprising an annular member within said one end body portion and having wedging engagement with its interior for distending the resilient members to deform said elastic element into said sealing position.

2. In an electrical conductor assembly as defined in claim 1 wherein the means for externally connecting adjacent end portions of adjacent lengths of pipe comprises an externally screwthreaded pin portion at least at one end portion of each pipe for mating engagement with an internally screwthreaded box portion at the end of an adjacent length of pipe whereby one of the end portions of the electrical conductor tube within the latter pipe terminates at the inner extremity of the box portion of said external connecting means, said annular element of elastic dielectric material being mounted in said inner extremity of said box portion for engagement by the pin portion of said external connecting means and deformation of its axially outer end portion into fluid tight sealing engagement with the contiguous surfaces of said pin and box portions, said annular elastic element having its axially inner end portion secured to the axially inner end portion of said tubular body, the major portion of said annular elastic element having slidable connection with said body for relative axial movement whereby said axially inner portion of said element is deformed into sealing position when axial inwardly-directed force is applied to the axially outer end of said body.

3. In an electrical conductor assembly as defined in claim 2 wherein said annular elastic dielectric element has an annular cavity in its interior, said tubular body having radial openings communicating with the cavity so as to expose the interior of said element to any pressure fluid within said body for equalizing the fluid pressures exerted against the exterior and interior of said element.

4. In an electrical conductor assembly as defined in claim 2 comprising a sleeve secured within the bore of said annular elastic dielectric element and slidably connecting said major portion of said element to said tubular body.

5. In an electrical conductor assembly as defined in claim 4 wherein said annular elastic dielectric element has an annular cavity in its interior, said tubular body having radial openings communicating with the cavity as to expose the interior of said element to any pressure within said body for assisting in the deformation of said element.

6. Means for electrically connecting and insulating the adjacent ends of inner electrical conductor tubes from the contiguous ends of lengths of pipe as defined in claim 2 wherein the means for maintaining said annular elastic dielectric element in its deformed sealing position and said tubular body against displacement comprises an annular member mounted in the bore of one end portion of said tubular body for axially inward movement relative to said body, wedge means between the exterior of the annular member and said bore of said discontinuous end portion of said tubular body for flexing and holding said resilient members radially outward into frictional engagement with the bore of the electrical conductor tube in which said body is mounted when said annular member is forced axially inward of the latter.

7. In an electrical conductor assembly as defined in claim 6 wherein said annular elastic dielectric element has an annular cavity in its interior, said tubular body having radial openings communicating with the cavity as to expose the interior of said element to any pressure fluid within said body for assisting in the deformation of said element.

8. In an electrical conductor assembly as defined in claim 1 wherein said annular element of elastic dielectric material has its axially inner end portion secured to the axially inner end portion of said tubular body, the major portion of said elastic dielectric element having slidable connection with said body for relative axial movement whereby said axially inner portion of said element is deformed into sealing position when axial inwardly directed force is applied to the axially inner end of said body.

9. In an electrical conductor assembly as defined in claim 1 comprising a sleeve secured within the bore of said annular elastic dielectric element and slidably connecting said element to said tubular body.

10. In an electrical conductor assembly as defined in claim 9 wherein said annular elastic dielectric element has an annular cavity in its interior, said tubular body having radial openings communicating with the cavity so as to expose the interior of said element to any pressure fluid within said body for equalizing the fluid pressures exerted against the exterior and interior of said element.

11. In an electrical conductor assembly as defined in claim 1 wherein said annular elastic dielectric element has an annular cavity in its interior, said tubular body having radial openings communicating with the cavity so as to expose the interior of said element to any pressure fluid within said body for equalizing the fluid pressures exerted against the exterior and interior of said element.

12. In an electrical conductor assembly of an electrical transmission system for a tubular fluid conductor composed of lengths of pipe and means externally connecting the ends of adjacent lengths of pipe, an inner electrical conductor for the electrical conductor assembly comprising an electrically conductive tube generally coextensive with and mounted within each pipe length in spaced electrically insulated relationship;

means for electrically connecting and insulating the adjacent ends of inner electrical conductor tubes from the contiguous ends of lengths of pipe including a generally continuous cylindrical tubular body of electrically conductive material having an external diameter generally equal to the internal diameter of the bores of said tubes for mounting in the end portions of said adjacent tubes so as to extend therebetween and provide electrical contact therewith upon coupling of said external connecting means, an annular element of elastic dielectric material of less axial length than the tubular body and mounted on the exterior thereof in spaced relation to the ends of said body for engagement with said end portions of said adjacent tubes and deformation into fluid-tight sealing engagement therewith and the contiguous internal surfaces of said adjacent pipe lengths so as to electrically insulate said tube ends from said pipe ends, means for maintaining the annular elastic dielectric element in its deformed sealing position and said tubular body against displacement upon uncoupling of said external connecting means, the means for maintaining said annular elastic dielectric element in its deformed sealing position and said tubular body against displacement comprising an annular member mounted in the bore of one end portion of said tubular body for axially inward movement relative to said body, said one end portion of said body being resilient to permit radial flexing thereof, and wedge means between the exterior of the annular member and said bore of the resilient end portion of said tubular body for flexing said resilient body end portion radially outward into frictional engagement with the bore of the inner electrical conductor tube in which said body is mounted when said annular member is forced axially inward of the latter.

13. Means for electrically connecting and insulating the adjacent ends of inner electrical conductor tubes from the contiguous ends of lengths of pipe as defined in claim 12 wherein the wedge means comprises an interior surface of said bore of said resilient end portion of said tubular body tapered axially outward of said body.

14. Means for electrically connecting and insulating the adjacent ends of inner electrical conductor tubes from the contiguous ends of lengths of pipe as defined in claim 12 wherein the wedge means comprises an exterior surface of said annular member tapered axially inward of said tubular body.

15. Means for electrically connecting and insulating the adjacent ends of inner electrical conductor tubes from the contiguous ends of lengths of pipe as defined in claim 12 wherein the wedge means comprises an interior surface of said bore of said resilient end portion of said tubular body tapered axially outward thereof and an exterior surface of said annular member tapered axially inward of said body oppositely to the interior tapered surface of said body for coacting therewith.

16. Means for electrically connecting and insulating the adjacent ends of inner electrical conductor tubes from the contiguous ends of lengths of pipe as defined in claim 15 wherein the coacting tapered wedge surfaces of said tubular body and said annular member are screwthreaded.

17. Means for electrically connecting and insulating the adjacent ends of inner electrical conductor tubes from the contiguous ends of lengths of pipe as defined in claim 2 wherein the means for maintaining the annular elastic dielectric element in its deformed sealing position and said tubular body against displacement comprises coacting tapered surfaces between the annular member and said bore of said discontinuous end portion of said tubular body providing the wedging engagement for flexing said resilient members radially outward into frictional engagement with the bore of the electrical conductor tube in which said body is mounted when said annular member is forced axially inward of the latter.

18. Means for electrically connecting and insulating the adjacent ends of inner electrical conductor tubes from the contiguous ends of lengths of pipe as defined in claim 12 wherein the resilient end portion of said tubular body is slitted longitudinally at spaced intervals to provide flexible fingers.

19. In an electrical conductor assembly of an electrical transmission system for a tubular fluid conductor composed of lengths of pipe and means externally connecting the ends of adjacent lengths of pipe, an inner electrical conductor for the electrical conductor assembly comprising an electrically conductive tube generally coextensive with and mounted within each pipe length in spaced electrically insulated relationship;

means for electrically connecting and insulating the ends of adjacent tubes from the contiguous ends of adjacent pipe lengths including a tubular body of electrically conductive material having an external diameter generally equal to the internal diameter of the bores of said tubes for mounting therein so as to extend therebetween and provide electrical contact therewith upon coupling of said external connecting means, an annular element of elastic dielectric material mounted on the tubular body and in spaced relation to the ends of said body for deformation into fluid-tight sealing engagement with said adjacent tubes and the contiguous internal surfaces of said adjacent pipe so as to electrically insulate said tube ends from said pipe ends, means for maintaining the annular elastic dielectric element in its deformed sealing position and said body against displacement upon uncoupling of said external connecting means, said annular elastic element havings its axially inner end portion secured to the axially inward portion of said tubular body, the major portion of said elastic element having slidable connection with said body for relative axial movement whereby said axially inner portion of said element is deformed when axial inwardly directed force is applied to the axially outer end of said body.

20. In an electrical conductor assembly as defined in claim 19 comprising a sleeve secured within the bore of said annular elastic element for slidably connecting said elastic element to said tubular body.

21. In an electrical conductor assembly as defined in claim 20 wherein said tubular conductor body has radial openings elongated axially thereof, the sleeve has internal radial projections engaged within the elongated openings to slidably connect said sleeve to said body and prevent relative rotation therebetween.

22. In an electrical conductor assembly in claim 21 wherein said annular elastic element has an annular cavity in its interior, the elongated openings of said tubular body communicating with the cavity so as to expose the interior of said elastic element to any pressure fluid within said body for equalizing any fluid pressure exerted against the exterior and interior of said element.

* * * * *